US005216981A

United States Patent [19]

Solomon et al.

[11] Patent Number: 5,216,981

[45] Date of Patent: Jun. 8, 1993

[54] COAL-FIRED HEATING APPARATUS AND METHOD

[75] Inventors: Peter R. Solomon, West Hartford; Stephen C. Bates; Robert M. Carangelo, both of Glastonbury; David G. Hamblen, East Hampton, all of Conn.

[73] Assignee: Advanced Fuel Research, Inc., East Hartford, Conn.

[21] Appl. No.: 644,269

[22] Filed: Jan. 22, 1991

[51] Int. Cl.[5] ..... F22B 23/06

[52] U.S. Cl. ..... 122/367.3; 122/4 D; 122/6 A

[58] Field of Search ..... 122/367 R, 367 A, 367 C, 122/4 D, 6 A, 42, 43, 391, 392; 110/233, 234

[56] References Cited

U.S. PATENT DOCUMENTS

| | | | |
|---|---|---|---|
| 3,732,850 | 5/1973 | Coley et al. | 122/367.3 |
| 4,453,498 | 6/1984 | Juhász | 122/367.1 |
| 4,501,232 | 2/1985 | Gordbegli et al. | 122/367.3 |
| 4,679,528 | 7/1987 | Krans et al. | 122/367.3 |
| 4,993,332 | 2/1991 | Boross et al. | 110/245 |
| 5,054,436 | 10/1991 | Dietz | 122/4 D |

*Primary Examiner*—Henry C. Yuen
*Attorney, Agent, or Firm*—Ira S. Dorman

[57] ABSTRACT

An aerodynamically cleaned heat-exchanger is used in heating apparatus in which the radiant energy of a dirty fuel, such as coal or char, is efficiently recovered while the exposed heat-exchange components are protected from the deleterious combustion products.

26 Claims, 2 Drawing Sheets

COAL-FIRED HEATING APPARATUS AND METHOD

BACKGROUND OF THE INVENTION

Because of the erosive and corrosive character of the constituents that they contain, the combustion products of certain "dirty" fuels, notably coal, are often unsuitable for use directly as the working fluid for gas turbines and the like. It is of course common practice to utilize heat exchangers to convectively transfer thermal energy from a hot, dirty gas to a heat-transfer fluid, thereby reducing the deleterious effects of the gas by subjecting only stationary parts to it. Further protection can be afforded by sweeping the exposed surfaces of the heat exchanger with a relatively clean (or only moderately dirty) gas; it is believed that proposals have been made to aerodynamically clean high temperature heat exchangers for use in magnetohydrodynamic recuporators. (Hoover et al; NASA Final Report No. NAS-3-19407, 1976)

As far as is known, no method or apparatus has heretofore been provided by which the energy produced by the burning of coal, char, and other dirty fuels, can be recovered in a highly efficient and yet practical manner while, at the same time, effectively shielding the energy-recovery structures from erosive and corrosive components of the combustion gases.

SUMMARY OF THE INVENTION

The objects of the present invention are therefore to provide heating apparatus, and a method utilizing the same, by which the radiant energy of a fuel can be recovered efficiently while protecting the components of the heat-exchange unit utilized against deleterious effects of combustion product constituents.

Certain of the foregoing and related objects of the invention are attained by the provision of heating apparatus comprised of means defining a heating chamber, a burner for producing a flame within the chamber, heat exchanger means, and gas introducing and flow-directing means. The heat exchanger means includes a plurality of tubes extending within the heating chamber, which tubes have surfaces disposed to receive radiant energy from a proximate flame produced by the burner, and the gas introduction means so directs the flow as to pass over the radiation-receiving surfaces. The fluid passing through the tubes can therefore be heated, directly or indirectly, by radiant energy from the flame absorbed by the fluid or by the heat-exchange tubes, with the radiation-receiving surfaces of the tubes being protected from deleterious substances that may be contained in the burner flame by a flow of gas issuing from the introducing means.

Other objects of the invention are attained by the provision of a method for heating a fluid by passing it through a heat-exchange tube in a heating chamber, as described. A flame is produced proximate the radiation-receiving surface of the heat-exchange tube, by effecting combustion of a first, usually relatively unclean, fuel, to directly or indirectly heat the fluid passing through the tube. Substantial contact of the irradiated surface of the tube by the deleterious combustion products is prevented by sweeping the tube with a flow of clean gas (i.e., a gas that is at least relatively free from erosive and corrosive substances).

DETAILED DESCRIPTION OF THE ILLUSTRATED AND PREFERRED EMBODIMENTS

Figure 1:
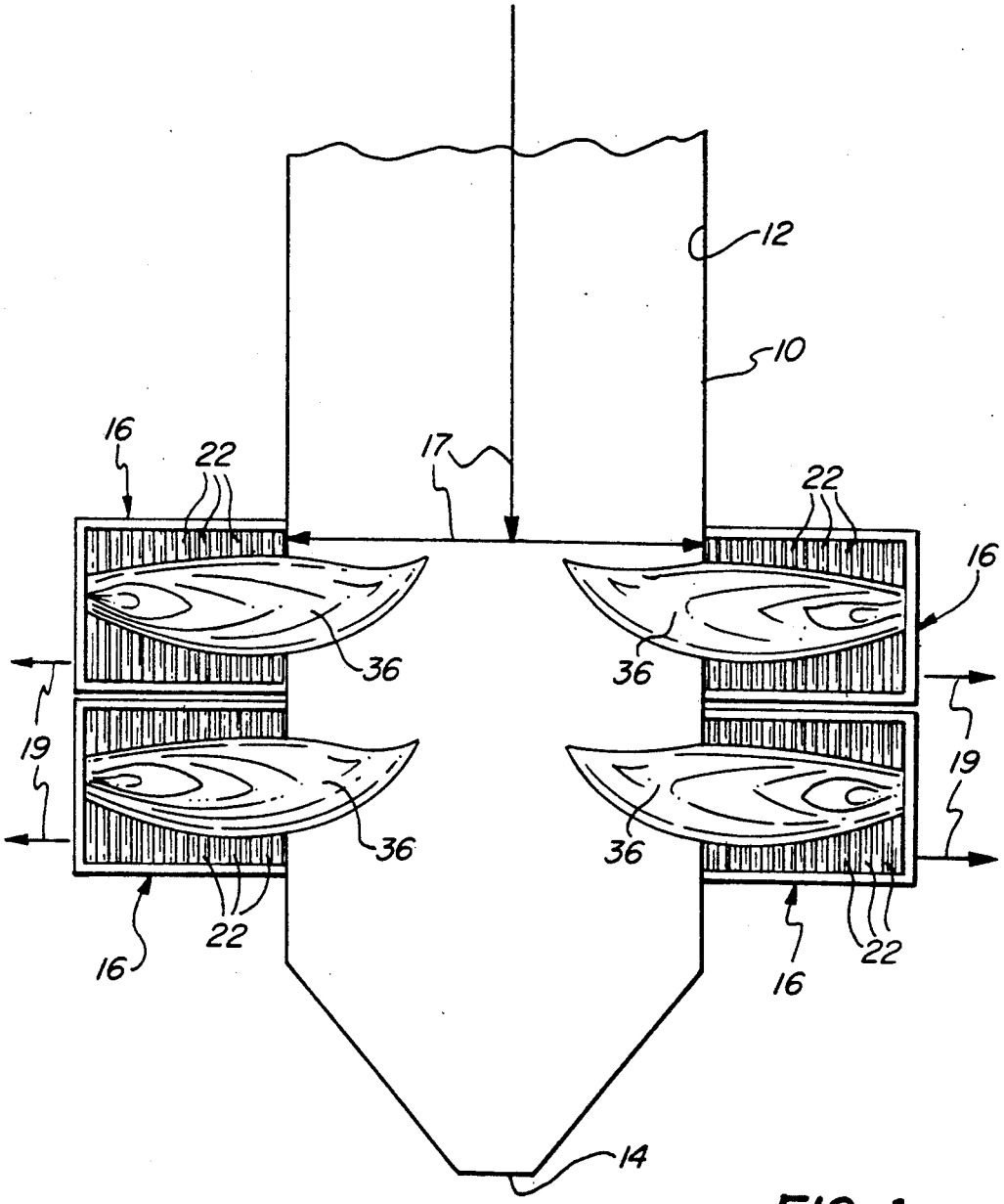
FIG. 1 is a schematic representation of a furnace which incorporates heating apparatus embodying the present invention.

Turning now in detail to the appended drawings, FIG. 1 shows a furnace comprised of a housing 10 having gas flow and slag outlets at 12 and 14, respectively, and incorporating four heat-exchange units embodying the invention, each being generally designated by the numeral 16 and having gas inlet lines as at 17. Combustion products flowing through the outlet 12 may be used, for example, in an associated preheater system (not illustrated) from which the lines 17 extend; air heated in the units 16 exits through the lines 19.

Figure 2:
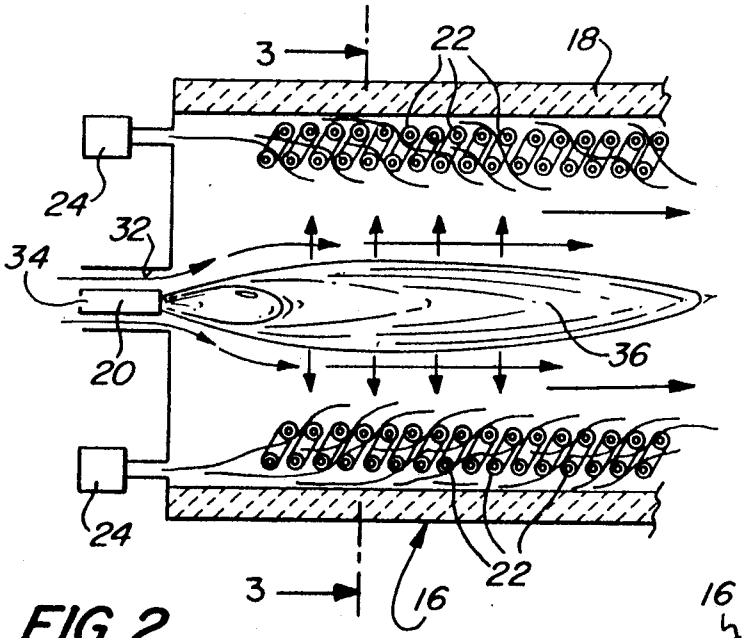
FIG. 2 is a schematic representation of the heating apparatus of FIG. 1, drawn to an enlarged scale.
Figure 3:
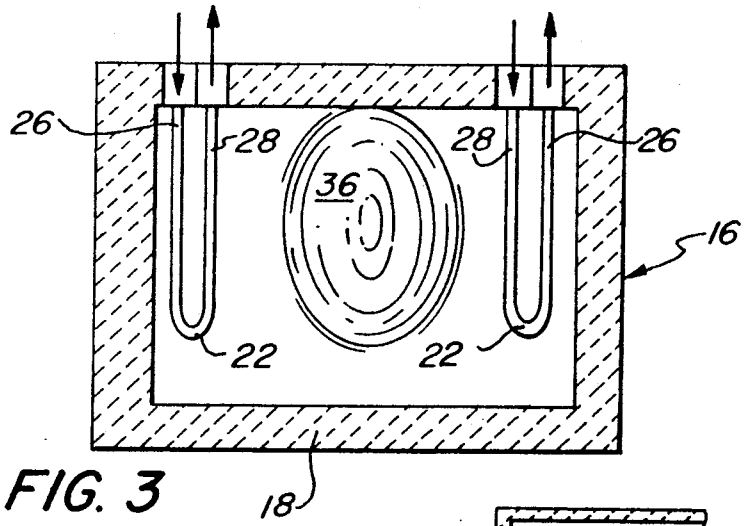
FIG. 3 is a view of the apparatus of FIG. 2, taken along line 3—3 thereof.

Details of the heat-exchange units 16 are shown in FIGS. 2 and 3. Each unit consists of an insulating refractory sidewall 18, a coal burner 20, arrays of heat-exchange tubes 22, and auxiliary burners 24. The burners 20, 24 are located at a common end of the sidewall 18; inlet ducts 32 admit combustion air thereat, and pulverized coal, burned to produce a flame 36, is introduced through burner inlet 34. The inlet and the outlet ends, 26 and 28 respectively, of the tubes 22 are so disposed that the fluid passing through them exits through the leg closest to the flame 36.

Figure 4:
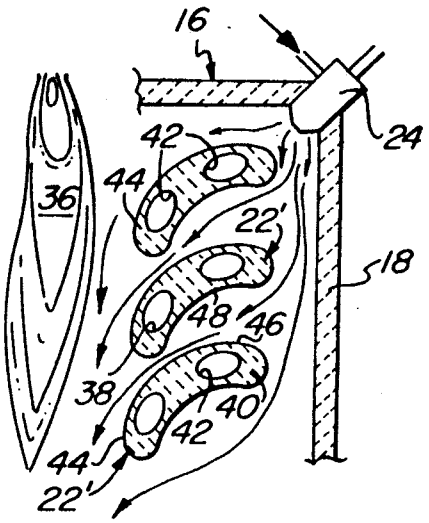
FIG. 4 is a schematic representation of a portion of a heating unit of the kind shown in the previous Figures, illustrating the cross-sectional configuration of one form of heat-exchange tubes suitable for use therein.

The tubes 22', illustrated in FIG. 4, are presently regarded to comprise a preferred embodiment of the invention. They have a generally arcuate, aerodynamic cross-sectional configuration, uniform throughout at least the major portion of their lengths, and they cooperate with one another to promote sweeping of the gas from the burners 24 across their flame-irradiated faces. Each tube 22' consists of a head portion 38 and neck portion 40; the head portions 38 provide radiation-receiving faces 44, which are directed inwardly and present an optically large projected area to the coal flame 36. Needless to say, the energy absorbed or transmitted by or through the tubes 22' serves to heat the fluid flowing through the ducts 42.

As suggested by the flow lines, the clean combustion gas produced at the burners 24 is directed toward the tubes 22'. The gas passes between the confronting surfaces 46, 48 on the neck portions 40 of the adjacent tubes, being channelled thereby to sweep, upon exit, across the faces 44. This aerodynamic design serves to maintain the faces 44 free from ash deposits, and also to shield them from the deleterious effects of the particles and corrosive substances contained in the coal flame 36.

Figure 5:
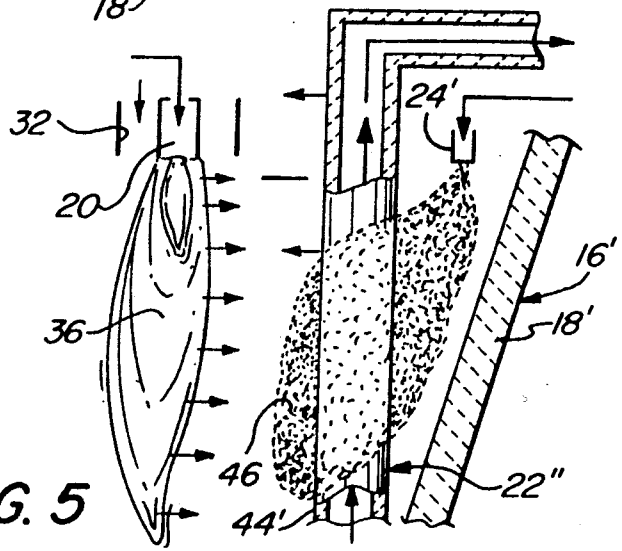
FIG. 5 is a similar representation, showing an alternative heat-exchange tube arrangement.

A second form of heat-exchange units embodying the invention is illustrated in FIG. 5, and is generally designated by the numeral 16'. In it, the heat-exchange tube, generally designated by the numeral 22'', is oriented with its gas flow axis parallel to that of the flame 36, rather than perpendicular to it, as in the preceding Figures. Also, the wall 18' of the unit 16' tapers inwardly toward the flame axis, thus providing a restriction (which would of course be conical on a cylindrical wall), cooperating with the auxiliary burner 24' in promoting the flow of sweep gas 46 so as to pass about the tube 22'', including of course the surface 44' thereof.

It is well known that the potential problems that are associated with the use of coal combustion products, as working fluids for gas turbines and the like, are primarily attributable to diminished aerodynamic blade properties, and to erosion and corrosion, caused by ash, sulfur, and organically bound alkali and alkaline earth metal constituents. The same erosion and corrosion effects would be produced on heat-exchange elements exposed to such combustion products, in addition to which ash deposits would compromise the efficiency of thermal energy transfer through them. It will be appreciated that the cleansing action of the clean gas sweep, employed in accordance with the instant method and apparatus, ameliorates those adverse effects upon the heat exchanger tubes.

A particularly unique aspect of the invention resides of course in the proximate positioning of the heat-exchange tubes and the coal flame, so as to most efficiently recover the large amount of radiant energy that the flame contains. The aerodynamic cleaning effect herein described makes that technically feasible and effective, as a practical matter. Consequently, while the heat-exchange tubes may have any suitable form and arrangement, they will most desirably be so configured and disposed as to cooperate with one another in producing effective gas flows across their irradiated surfaces. It is believed that the desired aerodynamic effect is achieved by inducing increased velocities, and generally laminar, or low-turbulence, flow in the sweep streams. It is regarded to be of importance that turbulence in the coal flame, as well as in the sweep stream, be maintained at levels that are sufficiently low to avoid excessive intermixing of the two flows, as would compromise the sweep-gas shielding effect; on the other hand, some mixing may be desirable, so as to maximize temperatures within the unit.

It will be appreciated that an optimal arrangement of components, in any heating apparatus embodying the invention, will therefore depend upon aerodynamic and thermodynamic factors, as well as upon mechanical factors dictated, for example, by the simple need to provide adequate support for the tubes. Thus, the configuration of the heat-exchange unit may vary widely within the scope of the invention. It should be noted, for example, that the tubes may have their primary flow axes oriented either substantially perpendicular to the axis of the flame or parallel to it, both as illustrated.

The tubes and associated auxiliary burners, or flow-directing means, will desirably be positioned at spaced locations about the periphery of the heating apparatus. Although only two locations are shown in FIGS. 2 and 3 of the drawings, surrounding the flame with tubes, and providing suitable sweep-gas discharge locations associated therewith, will often be found to maximize the efficiency of energy recovery. For the same reason it will usually be desirable to so dispose the tubes that the heat-exchange fluid exits therethrough from the hottest part of the chamber. It will be appreciated that a plurality of heating units will desirably be employed in a given furnace, arranged in any suitable manner.

As will be evident to those skilled in the art, effective radiation absorption characteristics (i.e., high emissivity values at the temperatures prevailing within the heating chamber) can be afforded by fabricating the heat-exchange tubes from a suitable ceramic material, such as silicon carbide, silicon nitride, and the like. Such tubes will of course be made to efficiently absorb energy from the flame in at least a portion of the infrared spectral region, for indirect heating of the heat exchanger fluid. When, on the other hand, the fluid is to absorb the radiant energy directly, it will comprises a substance other than air, e.g., carbon dioxide, water, soot dispersions, and other substances of high infrared absorptive coefficient. In the latter case, the heat-exchange tube will normally be made from a material that is substantially transparent to radiation in at least the portion of the spectral region at which the fluid is efficiently absorptive.

In most instances, the sweep-gas will constitute the combustion product of a clean fuel such as natural gas, methane, and products of coal pyrolysis, carbonization, or gasification. Although it is conceivable that a hot, non-combustible gas may provide the sweep gas, the use of fuels burned in situ will generally provide optimal energy production and economics.

A principal attribute of the present method and apparatus is that they enable radiative and convective heat transfer from a moderately clean sweep stream, coupled with radiative heat transfer from the flame of a much larger, unclean fuel stream. These characteristics permit the attainment of significantly increased heat-exchange rates, as compared to those that would be realized by combustion of the gases downstream of the flame, while also shielding the heat-exchange surfaces against high concentrations of alkalis, sulfur, and ash; this in turn allows fabrication of the heat-exchange components from a wider selection of materials, and enables operation at higher temperatures, than would otherwise be possible. Nevertheless, it should be appreciated that benefit may be derived in some instances from carrying out the method of the invention using a relatively clean primary flame fuel, the combustion product of which is free from deleterious substances.

Thus, it can be seen that the present method and apparatus satisfies the expressed objects of the invention. Efficient recovery of radiant energy from a relatively unclean fuel is enabled, while the exposed heat exchanger components are protected against the deleterious effects of its combustion products. The thus heated fluid may be utilized in any suitable application, including of course that of serving as the working fluid for a gas turbine.

Having thus described the invention what is claimed is:

1. Heating apparatus comprising: means defining a heating chamber; a burner for producing a flame within the chamber; heat exchanger means including a plurality of tubes extending within said chamber, each of said tubes having an inlet and an outlet for the passage of a fluid therethrough, and having a surface disposed to receive radiant energy from a flame produced proximate thereto by said burner; and means, supplied separately from said burner, for introducing a gas into said chamber and for so directing the flow thereof as to sweep said energy-receiving surfaces of said tubes so to prevent substantially contact of said surfaces by any deleterious substances that may be contained in the burner flame; whereby radiant energy from such a flame may be used to efficiently heat a fluid passing through said tubes, and said tubes may be protected from deleterious substances therein by gas from said means for introducing and directing.

2. The apparatus of claim 1 wherein said burner projects its flame along a first axis, and wherein said tubes have longitudinal axes oriented substantially parallel thereto.

3. The apparatus of claim 1 wherein said burner projects its flame along a first axis, and wherein said tubes have longitudinal axes oriented substantially perpendicular thereto.

4. The apparatus of claim 1 wherein said chamber-defining means has internal restricting structure spaced from said means for introducing gas and defining a zone of diminished cross section, said restricting structure cooperating with said means for introducing in so directing the gas flow.

5. The apparatus of claim 1 wherein said means for introducing gas comprises a second burner, for producing a flow of relatively clean combustion gas.

6. The apparatus of claim 5 including a plurality of said second burners, said second burners and said tubes being disposed at a plurality of locations spaced about said chamber.

7. The apparatus of claim 1 wherein said tubes are so constructed as to provide optically large radiation-receiving faces oriented toward the flame produced by said burner, and wherein said tubes are of aerodynamic configuration and are so arranged as to promote sweeping of said faces with the gas from said means for introducing.

8. The apparatus of claim 7 wherein each of said tubes has an element that cooperate with the adjacent one of said tubes to promote such sweeping flow over said face of said adjacent tube.

9. The apparatus of claim 8 wherein said tubes are of generally arcuate cross-sectional configuration.

10. The apparatus of claim 1 wherein said radiation-receiving surfaces of said tubes are fabricated from a material that is capable of efficient absorption of radiation in at least a portion of the infrared spectral region.

11. The apparatus of claim 10 wherein said tubes are fabricated from a ceramic material.

12. The apparatus of claim 1 wherein said radition-receiving surfaces of said tubes are fabricated from a material that is substantially transparent to radiation in at least a portion of the infrared spectral region.

13. Heating apparatus comprising: means defining a heating chamber; a burner for producing a flame within the chamber; heat exchanger means including a plurality of tubes extending within said chamber, each of said tubes having an inlet and an outlet for the passage of a fluid therethrough, and having an absorption surface disposed to receive and absorb radiant energy from a flame produced proximate thereto by said burner; and means, supplied separately from said burner, for introducing a gas into said chamber and for so directing the flow thereof as to sweep said absorption surfaces of said tubes so as to prevent substantially contact of said surfaces by any deleterious substances that may be contained in the burner flame; whereby said tubes may absorb radiant energy from a flame produced by said burner, for heating of a fluid passing therethrough, and may be protected from deleterious substances in the flame by gas from said means for introducing and directing.

14. A method for heating a fluid, comprising the steps:

providing a heat-exchange tube within a heating chamber, said tube having a radiation-receiving surface fabricated from a selected material;

passing the fluid to be heated through said tube, at least one of: (a) said selected material and (b) said fluid, being an efficient absorber of radiation in at least a portion of the infrared spectral region;

effecting combustion of a first fuel to provide a flame in proximity to said radiation-receiving surface of said heat-exchange tube, to thereby radiantly heat at least one of said surface and said fluid passing through said tube; and sweeping said radiation-receiving surface with a flow of a hot, clean gas that is relatively free from deleterious substances, so as to prevent substantially contact of said surface by any deleterious substances that may be contained in the combustion product of said first fuel.

15. The method of claim 14 wherein a plurality of said heat-exchange tubes are provided, said tubes being arranged adjacent one another in an array, and being aerodynamically configured so that gas passing between two adjacent tubes is caused to sweep effectively said radiation-receiving surface of one of said adjacent tubes.

16. The method of claim 14 wherein both said flame and also said clean gas flow are of low turbulence, to minimize intermixing thereof.

17. The method of claim 14 wherein said fluid flows in such direction that in exiting said chamber it passes finally through the hottest portion thereof.

18. The method of claim 14 wherein said first fuel is relatively unclean, and wherein said combustion product contains deleterious substances.

19. The method of claim 18 wherein said unclean fuel is coal.

20. The method of claim 14 wherein said method includes the step of combusting a second fuel to produce said flow of hot, clean gas.

21. The method of claim 20 wherein said second fuel is selected from the class consisting of natural gas, methane, coal pyrolysis products, coal carbonization products, and coal gasification products.

22. The method of claim 14 wherein said selected material is capable of efficient absorption of radiation in at least a portion of the infrared spectral region.

23. The method of claim 21 wherein said heat-exchange tube is fabricated from a ceramic material having high emissivity values at the temperatures prevailing within said heating chamber, said ceramic material constituting said selected material.

24. The method of claim 14 wherein said fluid is an efficient absorber of radiation in at least a portion of the infrared spectral region.

25. The method of claim 24 wherein said selected material is substantially transparent to radiation in said portion of the infrared region.

26. A method for heating a fluid, comprising the steps:

providing a heat-exchange tube within a heating chamber, said tube having a radiation-absorbing surface;

passing the fluid to be heated through said tube;

effecting combustion of a relatively unclean fuel to provide a flame in proximity to said radiation-absorbing surface of said heat-exchange tube, to thereby radiantly heat said surface and, in turn, heat said fluid passing through said tube, the combustion product containing deleterious substances; and sweeping said radiation-absorbing surface with a flow of hot, clean gas that is relatively free from deleterious substances, so as to prevent substantially contact of said surface by said deleterious substances in said combustion product.

* * * * *

UNITED STATES PATENT AND TRADEMARK OFFICE

CERTIFICATE OF CORRECTION

PATENT NO. : 5,216,981

DATED : June 8, 1993

INVENTOR(S) : Peter R. Solomon, Stephen C. Bates, Robert M. Carangelo, David G. Hamblen It is certified that error appears in the above-identified patent and that said Letters Patent is hereby corrected as shown below:

Column 1, after "COAL-FIRED HEATING APPARATUS AND METHOD" insert --This invention was made with Government support under Contract No. DE-AC22-92PC92196 awarded by the Department of Energy. The Government has certain rights in this invention.--

Claim 1, column 4, line 65, insert after "so" the word --as--.

Claim 8, column 5, line 34, delete "cooperate" and substitute therefor --cooperates--.

Signed and Sealed this

Twentieth Day of September, 1994

Bruce Lehman

*Attest:*

BRUCE LEHMAN

*Attesting Officer*

*Commissioner of Patents and Trademarks*